US009316018B2

(12) United States Patent
Bozikis

(10) Patent No.: US 9,316,018 B2
(45) Date of Patent: Apr. 19, 2016

(54) SUSPENDED DWELLING

(71) Applicant: Vaios Bozikis, Moraga, CA (US)

(72) Inventor: Vaios Bozikis, Moraga, CA (US)

( * ) Notice: Subject to any disclaimer, the term of this patent is extended or adjusted under 35 U.S.C. 154(b) by 0 days.

(21) Appl. No.: 14/466,960

(22) Filed: Aug. 23, 2014

(65) Prior Publication Data

US 2016/0053507 A1 Feb. 25, 2016

(51) Int. Cl.

| | |
|---|---|
| ***E04H 15/04*** | (2006.01) |
| ***E04H 15/30*** | (2006.01) |
| ***E04H 15/00*** | (2006.01) |
| ***E04H 15/32*** | (2006.01) |
| ***E04H 15/54*** | (2006.01) |

(52) U.S. Cl.

CPC ..... *E04H 15/04* (2013.01); *E04H 15/001* (2013.01); *E04H 15/30* (2013.01); *E04H 15/32* (2013.01); *E04H 15/54* (2013.01)

(58) Field of Classification Search

CPC ..... E04H 15/04; E04H 15/30
USPC ..... 135/90; 5/121
See application file for complete search history.

(56) References Cited

U.S. PATENT DOCUMENTS

| | | | | |
|---|---|---|---|---|
| 961,704 | A * | 6/1910 | Mark | 5/121 |
| 968,017 | A * | 8/1910 | Wilson | 5/121 |
| 1,081,481 | A * | 12/1913 | Avery et al. | A45F 3/22 5/121 |
| 3,545,461 | A * | 12/1970 | Carlson | 135/90 |
| 4,320,542 | A * | 3/1982 | Cohen | 5/121 |
| 4,526,307 | A * | 7/1985 | Parker | E04H 15/04 135/95 |
| 4,597,401 | A * | 7/1986 | Fournier | 135/90 |
| 5,218,982 | A * | 6/1993 | Kenji | 135/90 |
| 6,085,767 | A * | 7/2000 | Maslow | 135/95 |
| 6,220,264 | B1 * | 4/2001 | Newman | 135/90 |
| 6,347,638 | B1 * | 2/2002 | Scott et al. | 135/95 |
| 6,353,946 | B1 * | 3/2002 | Steiner | 5/121 |
| 7,383,597 | B2 * | 6/2008 | Steiner | 5/121 |
| 7,699,068 | B2 * | 4/2010 | Helsdon | 135/90 |
| 8,365,749 | B2 * | 2/2013 | Overbaugh | 135/90 |
| 8,936,034 | B2 * | 1/2015 | Rhett, Jr. | 135/90 |
| 2010/0252083 | A1 * | 10/2010 | Ogle | 135/90 |
| 2010/0269874 | A1 * | 10/2010 | Jacoby | 135/90 |
| 2014/0116485 | A1 * | 5/2014 | Shirley-Smith | E04H 15/44 135/90 |
| 2014/0216511 | A1 * | 8/2014 | Brown et al. | 135/93 |
| 2015/0020857 | A1 * | 1/2015 | Dominick | 135/90 |
| 2015/0030790 | A1 * | 1/2015 | Duncan, III | 428/34.1 |

FOREIGN PATENT DOCUMENTS

| | | | | |
|---|---|---|---|---|
| WO | WO 2009007740 | A1 * | 1/2009 | E04H 15/04 |
| WO | WO 2012035320 | A1 * | 3/2012 | |

* cited by examiner

*Primary Examiner* — Noah Chandler Hawk

(57) ABSTRACT

An easily set up structure that is suspended between objects consisting of a platform made up of geometrical shapes, allowing for the structure to be lightweight, portable, and versatile in the way it is constructed.

2 Claims, 5 Drawing Sheets

3
3
2
2
5
4
3
3
7
2
1
2
6
6

SUSPENDED DWELLING

FIELD OF INVENTION

The invention relates to a tent or inhabitable structure that is suspended between objects.

SUMMARY OF INVENTION

The invention is a pre-manufactured structure that can be suspended between objects.

Tree houses are very popular but are a lot of work to build, are often damaging to trees, and are limited in where they can be built, because ridged materials are limited in the distance they are able to suspend, and a lot of material is required to build them. Also, the best areas for tree houses are often far away from roads, making transporting the materials to the sight an issue.

This invention uses pre-manufactured geometrical shapes as building blocks to create a platform, by bolting them together. Different arrangements can be used to make platforms of different shapes, so as to fit into different areas. As little as one piece can be used to create a hunting blind.

The platform is then suspended between anchor points using straps, cables, or an equivalent. Multiple platforms may be used to build multiple levels. The structure has posts that bolt through the floors, as well as walls and a roof that create an enclosure. Straps, cables or an equivalent are used to create tension securing platform, walls and roof in place.

This structure is easy to set up, does not damage trees as it is suspended with a strap that wraps around the anchor point, and is non intrusive. The platform can be built into different shapes so as to fit into different areas and to coincide with different anchor point locations. The structure is also lightweight enough to be portable and easy enough to set up and take down so that it can be set up in different locations.

Standard models can be produced to build specifically shaped and sized structures, or building blocks can be sold so as to leave the platform shape open-ended.

DETAILED DESCRIPTION OF INVENTION

Figure 6:
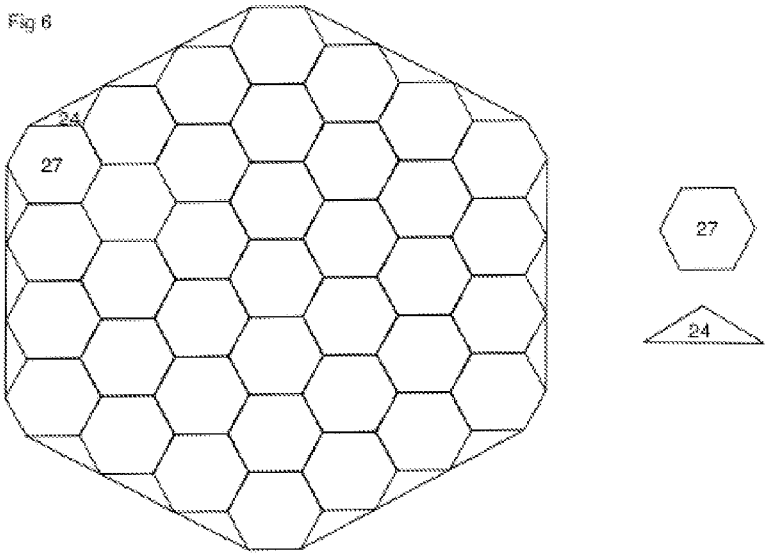
FIG. 6, Octagonal platform arrangement built with hexagons and triangles as to leave platform shape open-ended.
Figure 7:
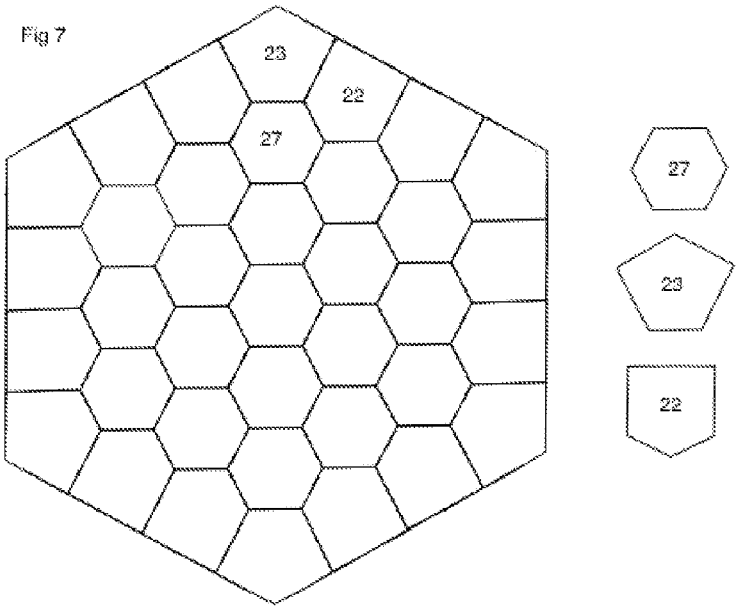
FIG. 7, Octagonal platform built with hexagons and to different pentagon shaped edge pieces showing an example of a platform that is designed to be built into one specific shape.

This invention is an inhabitable structure that can be suspended between objects or anchor points 6. It is composed of a platform 1, which is suspended in the air by straps, cables or an equivalent 2. Bolted to the platform are posts 15, which support the walls 4 (with doors and window openings 7), and roof 5, assisted by additional straps 2 and lighter duty cord 3. The platform is built from pre-manufactured geometrical shapes that are bolted together. The platform can be made up of but not restricted to; pentagons 21, squares 25, octagons 26, or hexagons 27, with triangles 24, or two different shaped pentagons 22, and 23, to create a platform 1 that can only be built into one shape. The platform can ether be built from shapes manufactured to make one possible platform shape, or from shapes that are meant to allow for many different platform shape possibilities, as seen in FIG. 6, and FIG. 7.

The platform is made of plastic with metal bracing 8 in each piece which goes from the points at which the pieces are bolted together to the center of the piece, where they intersect.

Figure 8:
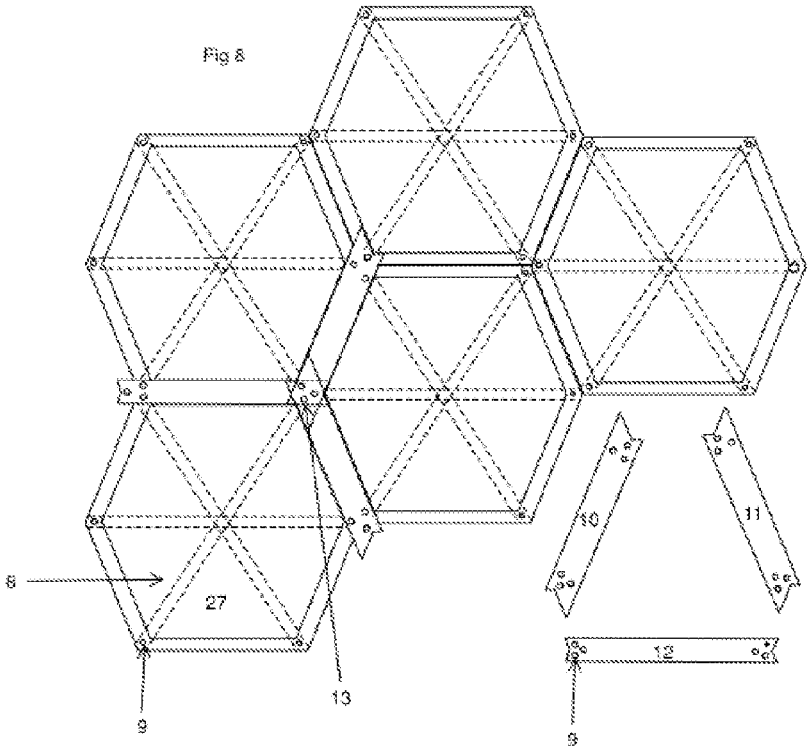
FIG. 8, Illustration showing how platform is bolted together.
Figure 9:
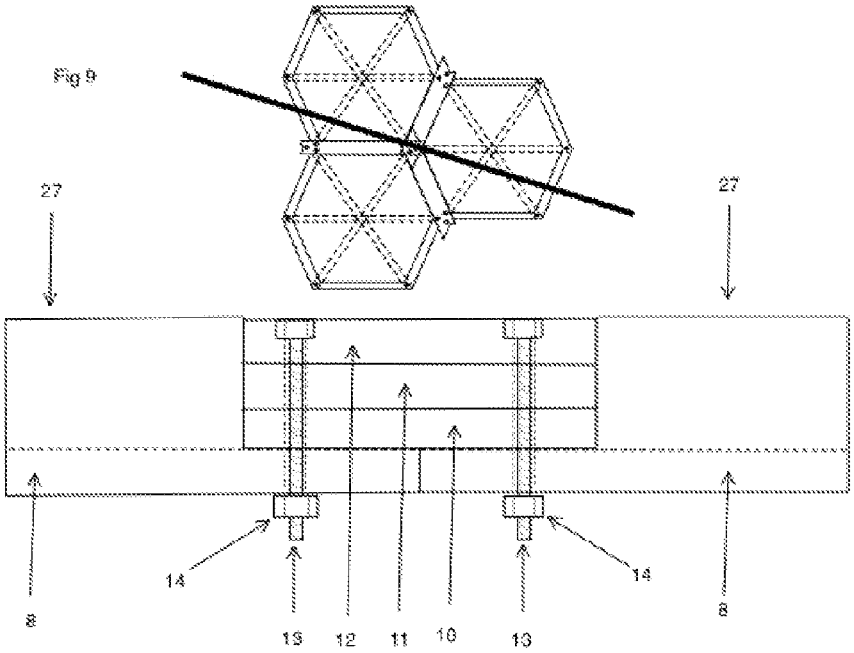
FIG. 9, Cross section illustrating how platform is bolted together.
Figure 10:
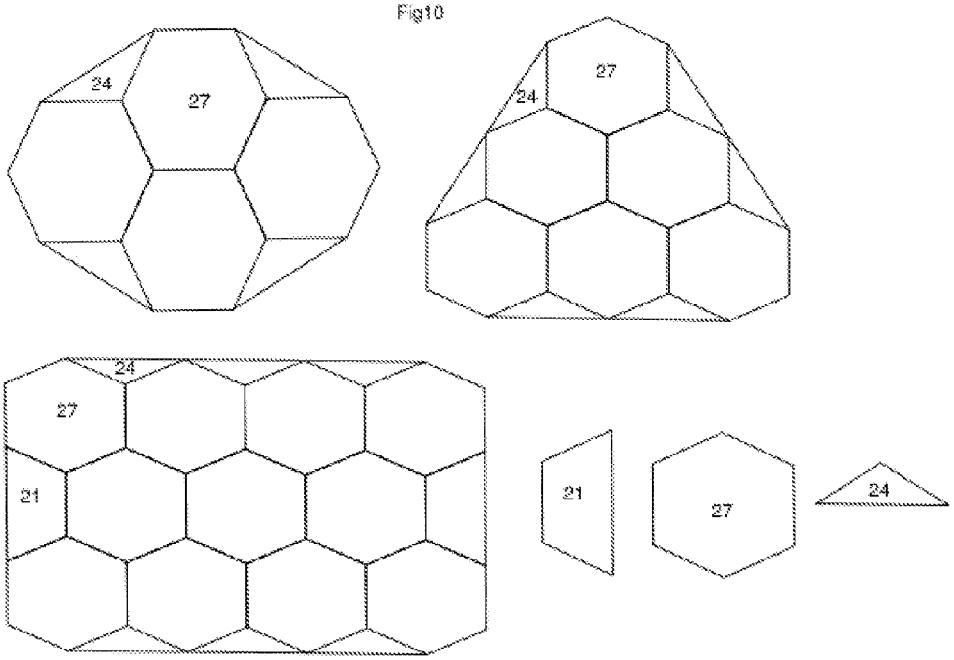
FIG. 10, Examples of some different platform shapes possible using hexagons, triangles and pentagons.
Figure 11:
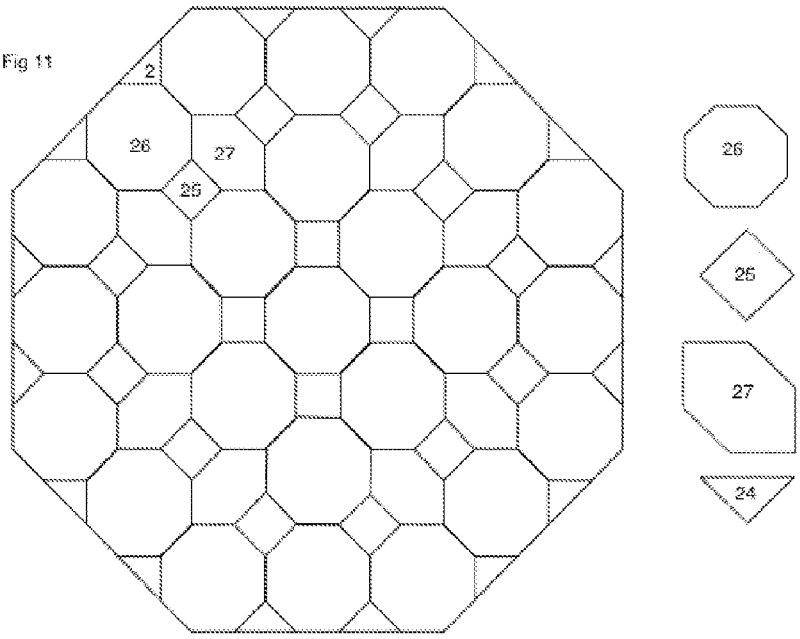
FIG. 11, Example of a way that a similar platform can be built using other shapes.

Three differently shaped brackets are used to bolt the separate platform pieces together. All three brackets overlap each other as well as all of the geometrical pieces that are in the area being bolted together. As seen in FIGS. 8 and 9 there is horizontal bracket 12 that lays on top of the other two brackets 10 and 11, and overlaps all three conjoining geometrical pieces. All of the brackets 10, 11, and 12, as well as the platform pieces, have holes 9 that line up. Bolts 13 and nuts 14 effectively secure the platform 1 together.

Figure 1:
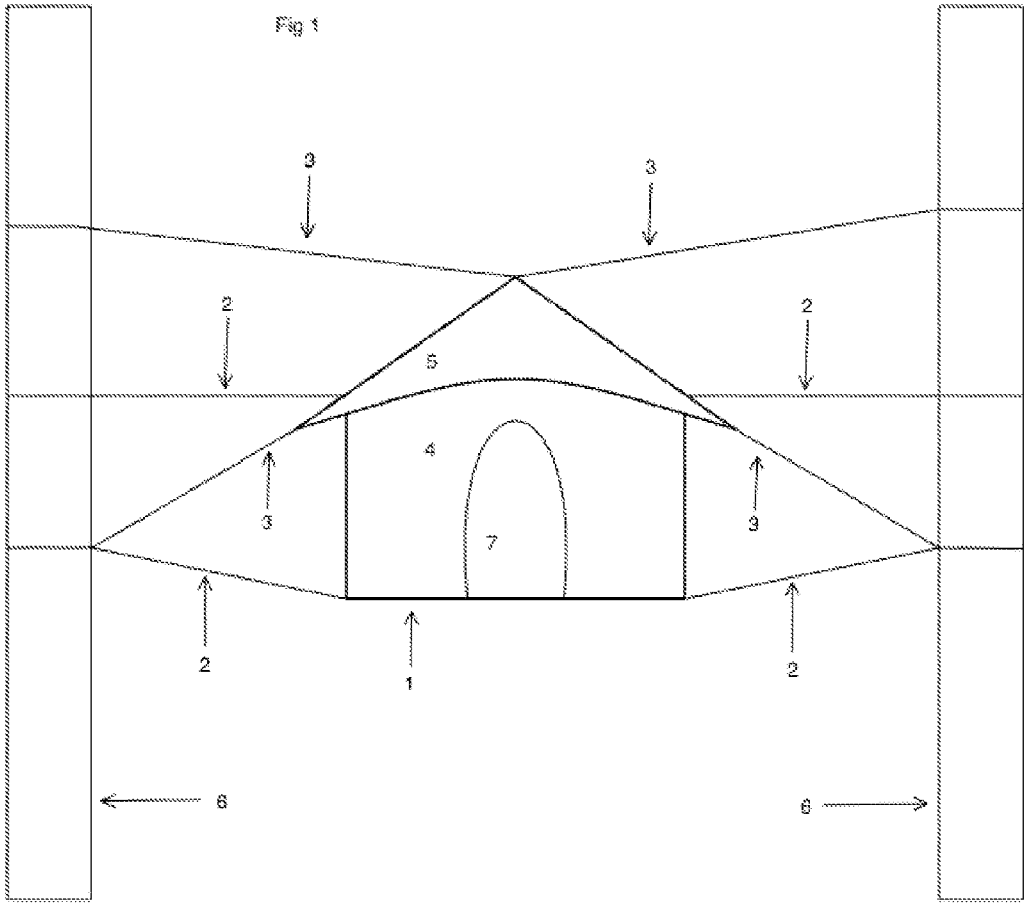
FIG. 1, Front view of structure suspended between anchor points.
Figure 3:
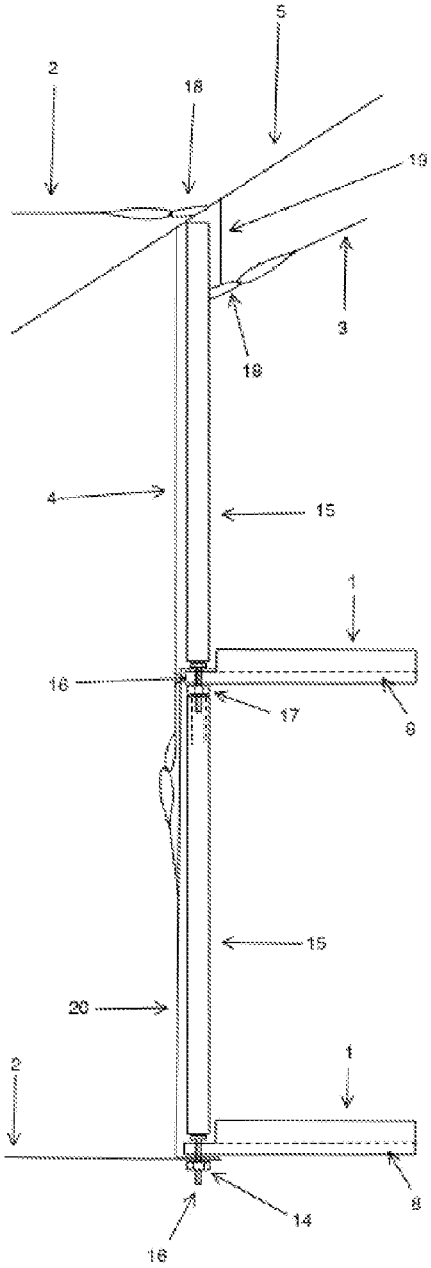
FIG. 3, Cross section structure where posts bolt together to build multiple levels.
Figure 2:
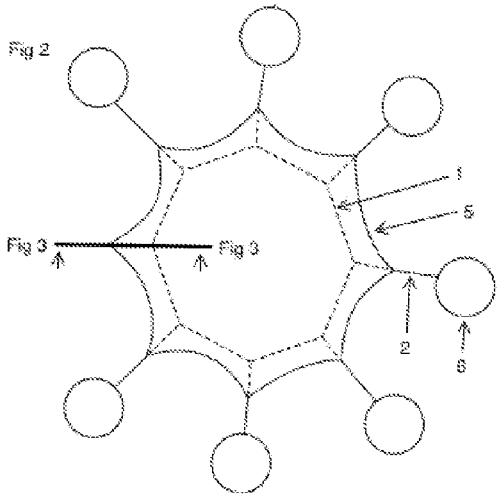
FIG. 2, Top view of structure with line indicating cross section.
Figure 4:
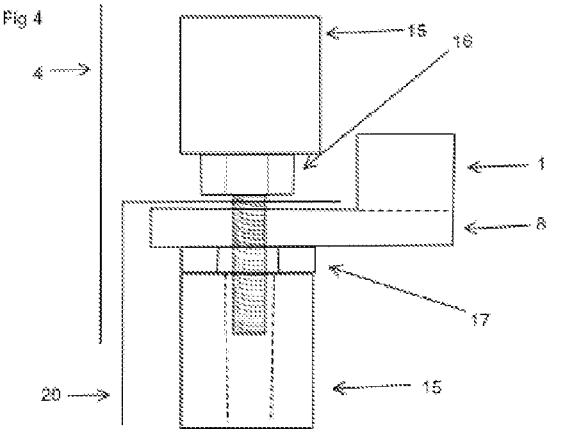
FIG. 4, Partial view showing how posts bolt together through floor.
Figure 5:
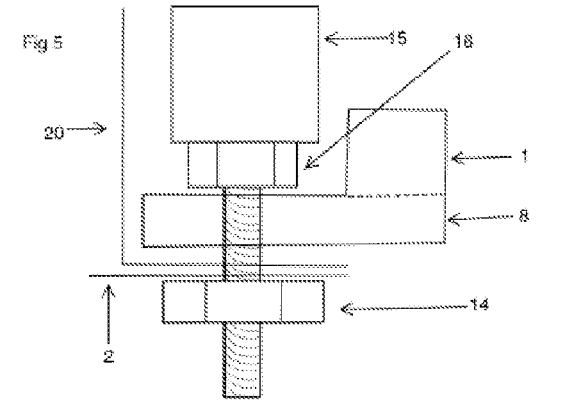
FIG. 5, Partial view showing how strap and wall secure to the bottom of structure.

Multiple platforms can be secured on top of one another as seen in FIG. 3, by using posts 15 that have bolts 13 welded to the bottoms and nuts 14 that are welded to the tops. The area on the roof 5 above the posts 15 which are held in place by a pocket 19 has a U ring 18 that is strapped to an anchor point 6 as to secure the walls 4 and roof 5 in place.

The bottom of walls 4 and in the case of multiple floors tops of the walls that are not connected to the roof 20 have holes on the top and bottom that coincide with the holes in the platform 9, so that the walls can be secured to the platform.

The invention claimed is:

1. A suspended structure comprised of:

one or more platforms comprised of one or more of joinable members wherein the joinable members comprise of a plurality of differently shaped generally planar geometrically-shaped floor members that are fastened together to create a solid platform unit and are capable of being assembled in different arrangements as to create differently shaped platforms an enclosure comprised of walls and a roof to fit over the platform;

vertical poles attached to the platform and the support walls to conjoin the platform with the enclosure; and straps, cables, or ropes, that are capable of suspending the structure from external anchor points.

2. The suspended structure of claim 1, wherein additional conjoining vertical poles can screw vertically into the vertical poles thereby securing one or more additional platforms along the vertical poles and allowing the platforms to be stacked to create a multi-level structure.

* * * * *